United States Patent [19]

Miner

[11] Patent Number: 4,544,160

[45] Date of Patent: Oct. 1, 1985

[54] PRACTICE DEVICE FOR PUTTING STROKES

[76] Inventor: Robert A. Miner, 31 Pine Arbor La., Vero Beach, Fla. 32960

[21] Appl. No.: 601,088

[22] Filed: Apr. 16, 1984

[51] Int. Cl.[4] ..... A63B 69/36

[52] U.S. Cl. ..... 273/186 C; 273/192; 273/187 R

[58] Field of Search ..... 273/187 R, 192, 191 R, 273/191 B, 186 C, 26 R, 186 R

[56] References Cited

U.S. PATENT DOCUMENTS

| | | | |
|---|---|---|---|
| 1,545,648 | 7/1925 | Fletcher | 273/192 |
| 2,750,195 | 6/1956 | Ching | 273/192 |
| 2,866,645 | 12/1957 | Cayot | 273/192 |
| 2,894,755 | 7/1959 | Scelzo, Jr. | 273/192 |
| 3,166,327 | 1/1965 | Champion | 273/187 R |
| 3,244,421 | 4/1966 | Hanna | 273/187 R |
| 3,332,688 | 7/1967 | Gevertz | 273/186 C |
| 3,860,247 | 7/1973 | Taylor | 273/186 C |
| 4,423,875 | 1/1984 | Miller et al. | 273/192 X |

*Primary Examiner*—George J. Marlo

*Attorney, Agent, or Firm*—Sughrue, Mion, Zinn, Macpeak and Seas

[57] ABSTRACT

The golf putting practice device includes a pair of elongated rigid strips that are held spaced apart and parallel by a transverse bar to define between their inner longitudinal edges a putter stroke area. A pair of plate members are moveable along each of the rigid strips and include lock elements to fix them at positions along the rigid strips selected by use of measurement indicia on the upper surfaces of the rigid strips. The transverse bar is adjustable to vary the spacing between the parallel strip and a further bar is secured to one of the moveable plate members and extends away from the strips to provide a foot location guide.

5 Claims, 4 Drawing Figures

PRACTICE DEVICE FOR PUTTING STROKES

BACKGROUND OF THE INVENTION

1. Field of the Invention

This invention relates to devices to be used by golfers to practice putting and improve this essential part of the game of golf.

2. Description of the Prior Art

Whether in social or tournament play, the outcome of a match between golfers frequently depends on how well each golfer putts into the hole after reaching the green. Putting, therefore is an critical part of each golfer's game and is a skill that requires frequent practice to perfect and maintain. However, practice of putting can be detrimental to the golfer's game if it is performed incorrectly, for then the practice develops bad, rather than good, habits.

Much has been written about various aspects of putting and what makes a good putting stroke vs a poor one. There are inconsistencies in advice given in the various writings, but there is general agreement that for putting practice to be effective in improving a golfer's putting skill, the practice must include (a) proper foot placement relative to the ball, (b) proper foot separation, (c) proper putter blade alignment and (d) execution of a smooth, natural grooved stroke.

Numerous schemes and devices have been developed and disclosed for the intended purpose of helping golfers improve their putting. Some such devices include a straight edge or the like against which the club head is to be stroked supposedly to obtain correct movement of the club head, see U.S. Pat. No. 2,750,195 and 2,866,645. A problem with such devices occurs because the swing that is natural for golfers in putting does not involve having the club face proceed throughout the backstroke in a natural manner with a return to square at impact with the ball on the return stroke.

Another form of putting practice device uses close, parallel bars to "capture" the club shaft just above the club head, again for the apparent purpose of requiring the golfer to move the club in a perfectly straight line during the putt swing, see U.S. Pat. No. 1,545,648. This type practice device involves the same problem mentioned above.

In another form of putting practice device, a pair of parallel channel guides are used to define a putter stroke area between them, see U.S. Pat. No. 2,894,755 and 3,332,688.

A putter swing area defined by parallel, longitudinal guides associated with foot positioning means has been used in the construction of putting practice devices, see U.S. Pat. No. 3,860.247. However, in this case, a full free swing of the putter is prevented by a back-stroke limiter thereby impairing a natural type swing in executing the putt. Also, the putter's feet are locked in a set position so the golfer is effectively prevented from varying his stance to accommodate for different length putts.

Nothwithstanding the various developments in the art of putting practice devices, including those mentioned above, further improvements are needed in the art to assist golfers to reach and retain maximum putting ability. The present invention provides such additional improvements.

OBJECTS

A principal object of the present invention is the provision of new improvements in devices to be used by golfers to improve their putting ability and to maintain such improvement.

Further objects include the provision of:

1. Golf putting practice devices that provide for grooving a putting stroke by standarizing the path of the putter at impact.

2. Such devices that make the putter conscious of a straight line running from the ball along a path into the hole.

3. Such devices that ensure the putter face is in a true right angle alignment, square to the hole at address, on the back stroke and during the final stages of the return stroke and at impact.

4. Such putting practice devices that allow the golfer to practice using an unimpaired, full natural swing in executing the putt.

5. Such devices that provide instruction for correct relative placement of the ball and feet in accordance with the putter's own parameters.

6. Such devices designed to accommodate both right and left handed golfers.

7. Such devices that may be used with a data recording system to correct putting faults and update failures.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished in accordance with the present invention by the provision of golf putting practice devices that comprise a first elongated rigid strip member (FERSM) having longitudinal measurement indicia on the top surface thereof, a second elongated rigid strip member (SERSM) substantially identical to the FERSM and spacer means to hold the FERSM and SERSM spaced apart and parallel to each other defining therebetween a rectangular putter stroke area (RPSA).

The spacer means comprises a third strip member (TSM) of adjustable length positioned normal to the FERSM and SERSM and there are clamp means on each end of the TSM to hold the FERSM and SERSM fixed relative to the TSM. Adjustment of the length of the TSM adjusts the width of the RPSA to compensate for the length of the putter blade, i.e., the width of the RPSA is adjusted to be just slightly greater than the length of the putter blade.

There is a first parallelogram plate member (FPPM) slideably carried on a longitudinal side of the FERSM opposite to the RPSA, the FPPM including means to lock it at any position along the FERSM selected using the measurement indicia.

There is also a second parallelogram plate member (SPPM) slideably carried on a longitudinal side of the SERSM opposite to the RPSA, the SPPM including means to lock it at any position along the SERSM selected using the measurement indicia.

A bar is fixed to the side of either the FPPM or the SPPM (depending whether the putter is right or left handed) that is opposite to the TSM, which bar serves in use of the practice device to properly position the forward foot of the user.

In preferred embodments of the new practice devices the FERSM and SERSM each have a longitudinal slot in their upper surface and the FPPM and SPPM each have tongue means depending from their lower surface, each of the tongue means being structured to slide in one of the longitudinal slots and thereby hold the transverse sides of the FPPM and SPPM normal to their respective FERSM and SERSM.

In the new practice devices, the means to lock the FPPM and SPPM may comprise spring biased friction buttons. Alternatively, the means to lock the FPPM and SPPM comprise set screws the leading end of which can engage a portion of the respective FPPM and SPPM.

Also in preferred embodiments, the FERSM and SERSM have pin means on their bottom surface to help hold the practice device in position upon a supporting surface, e.g., a carpet or putting green.

BRIEF DESCRIPTION OF THE DRAWINGS

A more complete understanding of the invention may be obtained by reference to the accompanying drawings in which.

DESCRIPTION OF THE PREFERRED EMBODIMENTS

Figure 1:
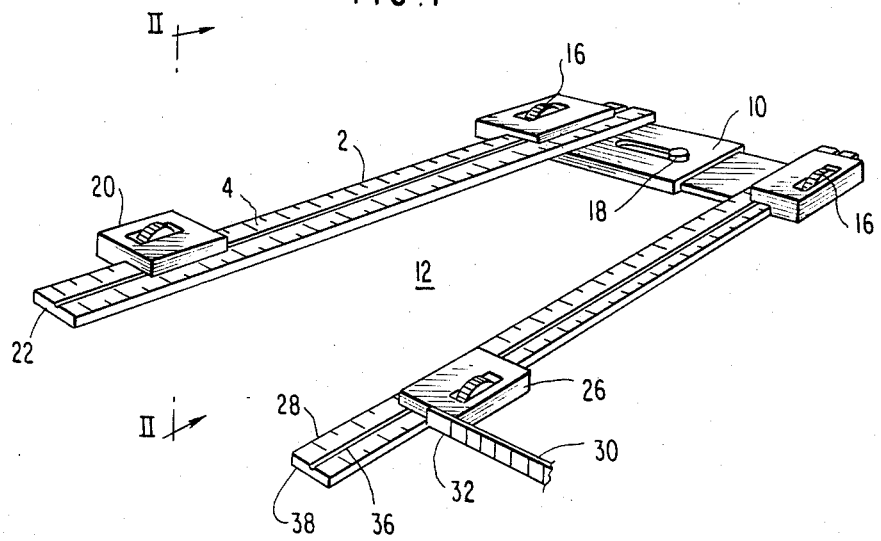
FIG. 1 is a perspective view of a golf putting practice device constructed in accordance with the invention.
Figure 2:
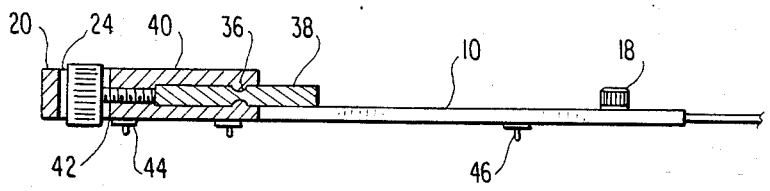
FIG. 2 is fragmentary, sectional view taken on the line II—II of FIG. 1.
Figure 3:
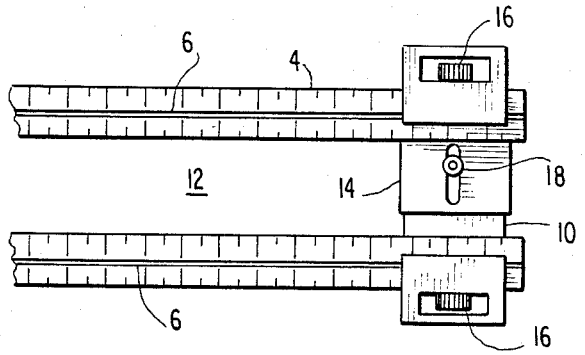
FIG. 3 is a fragmentary plan view of the rear end of the practice device of FIG. 1.
Figure 4:
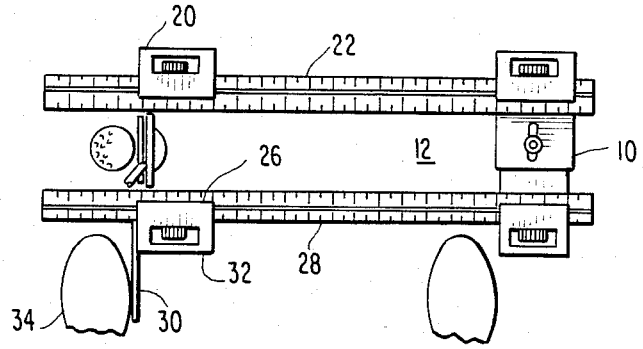
FIG. 4 is a top plan view of the practice device of FIG. 1 illustrating how the new devices condition the user for correct relative position of ball and feet plus correct putter alignment.

Referring in detail to the drawings, the golf putting practice device 2 of the invention comprises a first elongated rigid strip member 4 (FERSM) having longitudinal measurement indicia 6 on the top surface thereof, a second elongated rigid strip member 8 (SERSM) substantially identical to the FERSM and spacer means 10 to hold the FERSM and SERSM spaced apart and parallel to each other defining therebetween a rectangular putter stroke area 12 (RPSA).

The spacer means 10 comprises a third strip member 14 (TSM) of adjustable length positioned normal to the FERSM 4 and SERSM 8 and there are clamp means 16 on each end of the TSM 14 to hold the FERSM 4 and SERSM 8 fixed relative to the TSM 14. Adjustment of the length of the TSM 14 can be made via the wing nut 18 to adjust the width of the RPSA 12.

There is a first parallelogram or rectilinear plate member 20 (FPPM) slideably carried on a longitudinal side 22 of the FERSM 20 opposite to the RPSA 12. The FPPM 4 includes clamp means 24 to lock it at any selected position along the FERSM 4 using the measurement indicia 6.

There is also a second parallelogram or rectilinear plate member 26 (SPPM) slideably carried on a longitudinal side 28 of the SERSM 8 opposite to the RPSA 12. The SPPM 26 includes clamp means 24 to lock it at any position along the SERSM 8 selected using measurement indicia 6.

A bar or strip 30 is held by a screw or other fastener (not shown) to the fore side 32 of the SPPM 26 that is opposite to the TSM 10, which bar serves in use of the practice device by a right handed putter to properly position the forward foot 34 of the putter. In the case of a left handed putter, the bar or strip 30 will be held to the fore side of the FPPM 20.

In preferred embodiments of the new practice devices the FERSM 4 and SERSM 8 each have a longitudinal slot 36 in their upper surfaces 38 and the inner side 40 of both the FPPM 20 and SPPM 26 is structured to slide in the longitudinal slots 36 and thereby hold the transverse sides of the FPPM 20 and SPPM 26 normal to their respective FERSM 4 and SERSM 8.

In the new practice devices, the clamp means 24 may comprise spring biased friction buttons (not shown). Alternatively, the clamp means 24 comprise set screws 42, the leading end 44 of which can engage a portion of the respective FERSM 4 and SERSM 8.

Also in preferred embodiments, the FPPM 20 and SPPM 26 have pin means 46 on their bottom surface to help hold the practice device in position upon a supporting surface, e.g., a carpet or putting green.

Putters conventionally have blades (faces) that vary in length from 3 to 4 inches. Hence, the FERSM 4 and the SERSM 8 will generally be positioned apart about $\frac{1}{4}$ to $\frac{1}{2}$ inch wider than the putter blade length.

It is essential in performing the putting stroke that upon impact of the putter with the ball that the putter blade be absolutely perpendicular to the line that the ball is to initially travel to reach the cup. Of course, the total length of travel of the ball may not be a straight line, e.g., it may need to curve to compensate for contour of the green. The new devices 2 of the invention enable the user to perform the putting stroke in this manner. Thus, the two fore edges of the FPPM 20 ad the SPPM 26 indicate to the putter a straight line across the RPSA 12 to which the putter plate must be parallel when the ball is addressed and also upon impact of the putter with the ball on the return stroke. The FPPM 20 and SPPM 26 are advantageously equal in length from their fore edge to their rear edge. It has been found that when these elements are so sized, the rear edges also serve to indicate to the putter a line across the RPSA 12 to which the putter must be parallel during the backstroke and the return stroke.

The preferred fore foot (left foot for a right handed putter; right foot for a left handed putter) position is about 6 to 7 inches from the end of the toe to the ball.

The preferred position of the ball is directly opposite the toe of the fore foot or slightly to the rear of this position. However, the new devices 2 provide for the ball to be moved further rearwardly along the RPSA 12 to conform to desires of those putters that like a more rearward positioning of the ball relative to the fore foot. This is accomplished by moving the FPPM 20 and SPPM 26 so that their fore edges form a straight line that passes through the leading edge of the ball.

The distance between the right and left feet of the putter is a matter of choice and usually depends on the distance from the ball to the hole. Thus, for longer putts, the feet are usually placed further apart than for shorter putts. A typical stance for a 10 to 12 foot putt will have the feet about 10 inches apart.

The position of the rear foot to the fore foot is also a matter of choice, e.g., they may be (a) parallel to each other, (b) for a slightly closed stance, the rear foot is slightly back of the fore foot, and (c) for an open stance, the toe of the rear foot will be slightly ahead the toe of the fore foot. The alternative (b) is preferred since it provides for a freer backstroke.

The bar 30 assists the putter in positioning the fore foot. However, if the putter desires to position his feet in a side saddle slant, the positioning bar 30 may be removed. With the device 2 so modified, the putter can still use the device 2 with its putter blade alignment members FPPM 20 and SPPM 26 to insure a positive right angle position of the putter blade relative to the initial movement path of the ball on impact.

What is claimed is:

1. A golf putting practice device comprising a first elongated rigid strip member having longitudinal measurement indicia on the top surface thereof, a second elongated rigid strip member substantially identical to said first elongated rigid strip member, adjustable spacer means connected to said first and second elongated rigid strip members at one end thereof to hold said first and second strip members in spaced apart parallel relation to each other while defining therebetween a rectangular putter stroke area, a first rectilinear plate member slidably carried on said first strip member for sliding movement towards and away from said adjustable spacer means and first locking means for selectively locking said first rectilinear plate member to said first strip member at a desired position, a second rectilinear plate slidably carried on said second strip member for movement toward and away from said adjustable spacer means and second locking means for selectively locking said second rectilinear plate member to said second strip member at a desired position and a bar secured to said second rectilinear plate member and extending outwardly away from said rectangular putter stroke area perpendicular to said second strip member for locating the forward foot of the user perpendicular to said second strip member.

2. A golf putting practice device as set forth in claim 1 wherein said first and second strip members each have a longitudinal slot in the upper surface thereof and said first and second rectilinear plate members each have tongue means depending from the lower surface thereof complementary to said longitudinal slots in order to maintain the sides of said first and second rectilinear plate members normal to the respective first and second strip members.

3. A practice device as set forth in claim 1 wherein said first and second locking means are comprised of set screws threaded through said first and second rectilinear plate members for engagement with said first and second strip members.

4. A practice device as set forth in claim 3 wherein said first and second rectilinear plate members each have an aperture extending therethrough for receiving said set screws.

5. A practice device as set forth in claim 1 wherein said first and second strip members each have pin means secured to the bottom surfaces thereof for holding the practice device in position upon a supporting surface.

* * * * *